US009160120B2

(12) United States Patent
Schulze

(10) Patent No.: US 9,160,120 B2
(45) Date of Patent: Oct. 13, 2015

(54) SPARK PLUG CONNECTOR

(75) Inventor: Claus Schulze, Winsen/Aller (DE)

(73) Assignee: MOTORTECH GmbH, Celle (DE)

( * ) Notice: Subject to any disclaimer, the term of this patent is extended or adjusted under 35 U.S.C. 154(b) by 41 days.

(21) Appl. No.: 14/127,591

(22) PCT Filed: Aug. 2, 2012

(86) PCT No.: PCT/DE2012/100231

§ 371 (c)(1),
(2), (4) Date: Dec. 19, 2013

(87) PCT Pub. No.: WO2013/020552

PCT Pub. Date: Feb. 14, 2013

(65) Prior Publication Data

US 2014/0154901 A1 Jun. 5, 2014

(30) Foreign Application Priority Data

Aug. 11, 2011 (DE) ..... 20 2011 050 966 U

(51) Int. Cl.
*H01R 13/44* (2006.01)
*H01R 24/38* (2011.01)
*H01T 13/04* (2006.01)

(52) U.S. Cl.
CPC ..... *H01R 24/38* (2013.01); *H01T 13/04* (2013.01)

(58) Field of Classification Search
CPC ..... H01R 13/00; H01R 13/02; H01R 13/04; H01R 13/05; H01R 24/38
USPC ..... 439/125–127
See application file for complete search history.

(56) References Cited

U.S. PATENT DOCUMENTS

| | | | | |
|---|---|---|---|---|
| 2,762,021 | A * | 9/1956 | Battey et al. | 439/125 |
| 2,904,769 | A * | 9/1959 | Sampson et al. | 439/125 |
| 3,914,003 | A * | 10/1975 | Loy | 439/126 |
| 7,147,493 | B1 * | 12/2006 | Mahoney | 439/125 |
| 8,221,140 | B2 * | 7/2012 | Schneider et al. | 439/125 |

FOREIGN PATENT DOCUMENTS

EP 0362777 A1 4/1990

OTHER PUBLICATIONS

International Search Report issued Dec. 3, 2012 in International Application No. PCT/DE2012/100231.

* cited by examiner

*Primary Examiner* — Khiem Nguyen
(74) *Attorney, Agent, or Firm* — Patent Central LLC; Stephan A. Pendorf

(57) ABSTRACT

A spark plug connector (1) including a connector body (21) formed as an insulator having a spark plug high voltage contact (35) for producing a connection to and with a spark plug (6). The connector body (21) has a connection point (23) for receiving, mounting and/or connection of a spark plug connector (1) extending structural element (22). The structural element (22) is arranged at the junction (23) in such a manner such that the structural element (22) lengthens the connector body (21) on the side remote from the spark plug high voltage contact. The ignition cable (3) is held or guided along the length of the structural element (22) and the material of the structural element has a higher rigidity and strength and/or a lower density with at the same time less material than the material of the connector body (21).

16 Claims, 3 Drawing Sheets

Fig. 1 (SdT / prior art)

SPARK PLUG CONNECTOR

The invention relates to a spark plug connector comprising a connector body formed as an insulator having a spark plug high voltage contact for connecting to a spark plug and an ignition cable entering the connector body, on the side remote from the spark plug high voltage contact, for transmission of an ignition voltage from an ignition voltage source to the spark plug.

The term spark plug connector is understood to include spark plug extensions or ignition coil extensions and the like, which serve to establish contact with spark plugs of all types. The term spark plug is understood to include, inter alia, conventional spark plugs for producing a high voltage spark. Also included in the term spark plugs are other ignition means, which serve to ignite a gas or fuel-air mixture in the combustion chamber of an engine.

Different spark plugs, spark plug connectors, spark plug extensions and spark plug high voltage contacts are known from the prior art.

Spark plugs transmit ignition voltages of up to 50,000 volts from an ignition coil to the spark plug and are expected to have a service life of 30,000 operating hours and more under extreme environmental conditions, such as having a strong thermal cycling and high and sustained operating temperatures and in environments with aggressive media. The spark plug insulators must continuously withstand approximately 10,000 to 40,000 volts, possibly also peak values of 50,000 volts, and are manufactured according to the prior art over their entire length of high-quality, expensive PTFE. Thereby, the insulator forms at the same time the mechanical load-bearing structure of the connector.

A spark plug is known inter alia from DE 196 112 83 C1. An ignition connection for internal combustion engines with a spark plug connector is known, in which the spark plug connector is provided with a socket for the connection electrode of a spark plug, a plug contact enveloping plug sleeve and a connection for an ignition cable. Further, the spark plug connector exhibits in the following features in the combination: the spark plug connector consists of a one-piece, rigid and supporting female connector of an insulating material with a high melting point and high dielectric strength, such as polytetrafluoroethylene (PTFE), wherein the plug sleeve is designed to fit in the plug shaft of an engine cylinder, and be sealed against and elastically guided relative thereto. The connector sleeve is likewise sealingly and resiliently inserted over the ceramic shaft of the spark plug. Next the plug sleeve is provided with a ceramic inlet which includes the plug contact and the ignition cable terminal, wherein the plug contact and the ignition cable connection are so embedded isolated in ceramic inlet that the ceramic extends in the axial direction over the plug contact and the connector for the ignition wire.

Further, an electrical component with an electrical functional part and an insulator for high voltage applications, in particular an ignition systems, is known from DE 10 2010 016 881, wherein the insulator is a hollow body and the electric functional part is inserted in the hollow body in a casting compound, characterized in that the insulator is polyphenylene sulfide with a fiberglass additive.

DE 33 02 878 A1 shows a spark plug connector with a spark plug wire connection, which has a large shaft length and at its end remote from the spark plug has a connector adapter, adapted to seal the deep spark plug recess of the motor housing and support the long spark plug connector shaft. The plug stem is however not broken down into a connector body and a structural element plugged thereinto, but has a two-layer structure, namely an inner insulating body and an elastic insulating sleeve.

Next DE 36 00 509 A1 describes a spark plug connector that is indeed divided into three longitudinal sections; however, according to the figure the upper longitudinal portion does not serve for guiding and supporting an ignition cable, but is part of the spark plug connector to which the spark plug wire is connected.

U.S. Pat. No. 2,685,872 relates to a spark plug having a two-part insulator body, in which the part more distant from the combustion chamber can be made of a less expensive material. However, this document does not describe a spark plug connector, nor a separate structural element to be dedicated to the support/guidance of the ignition cable.

Furthermore, EP 2204888 A1 describes a male connecting portion to connect a spark plug wire with a spark plug. This plug-like member includes an insulating cast resin formed part with an elastic wrap. However, the component is not divided into a connector body and a thereupon seated elongating structural element.

Due to larger engines and new design models for engines, a very long spark plug connector is required, which establishes for example through a shaft in the engine block a connection between a spark plug and a high voltage source or the like. Spark plug connectors are currently manufactured in lengths of up to one meter and are, for example, completely made of polytetrafluoroethylene (PTFE), which leads to considerable costs. Due to their heavy weight, the spark plug connectors are vulnerable to strong engine vibration, so that their life is severely restricted. At the same time, the spark plug connector but must be able to insulate high voltages so that special requirements are necessary for this spark plug connector in terms of strength, weight and especially insulation ability.

The present invention has for its object to provide a spark plug, which makes it possible to reduce the stress on spark plug connectors due to ground vibrations, while simultaneously realizing the insulating effect at a very high level. In particular, the material costs are to be minimized to the greatest possible extent, although however the life span is to be increased.

This object is achieved with an arrangement according to claim 1.

As a result of the connector body having, on the side remote from the spark plug high voltage contact, a connection point for receiving, mounting and/or connection of a spark plug connector extending structural element, and the structural element is arranged at the connection point in such a manner that the structural element lengthens the connector body on the side remote from the spark plug high voltage contact, wherein the ignition cable is held or guided along the length of the structural element, wherein the material of the structural element has a higher rigidity and strength and/or a lower density than the material of the connector body, the weight of the entire spark plug connector is significantly reduced in comparison to the spark plug connectors known in the art, wherein however the properties of a conventional connector body are preserved, in particular the component integrity is not reduced.

In particular, the contact stresses imparted by engine vibrations are significantly reduced due to corresponding mass reduction, which leads to a significantly increased service life of the spark plug connector because the contact wear is significantly lower.

The material of the connector body is ceramic and/or plastic, in particular polytetrafluoroethylene (PTFE). The material of the structural element is a plastic, preferably provided with reinforcement fibers, more preferably a high-performance plastic with an impact strength 9-12 kJ/m$^2$, a heat resistance up to 260° C. and/or a high melting temperature of 280° C., mixed with a glass fiber content of 20 to 50%, preferably 30 to 40%. Particularly preferably, the structural member made of polyphenylene sulfide (PPS) having a glass fiber content of 30 to 40%, preferably 40% (GF40), and this material has the best cost/benefit ratio, and the best long-term performance with regard to the stability based on respective test series.

Further, the ignition cable from the junction, exiting the connector body, is guided within the structural element, wherein the passage within the structural element for the ignition cable is preferably configured as a channel, particularly preferably as a closed channel, and with a larger diameter than the outer diameter of the ignition cable. The ignition wire is thus optimally supported in the structural element, in which wear to the ignition cable due to vibration and elevated temperatures is minimized.

When the connection point or the connection element forms a permanent connection between the connector body and the structural element, wherein the connection of the connector body and the structural member is made by gluing, screwing, a bayonet closure, a pressing and/or welding, a positive connection is realized. A corresponding arrangement can also be provided on the side remote from the connection points, in order to secure the structural element.

Since the structural element side has a cable outlet on the side remote from the spark plug high voltage contact, wherein the cable exit preferably firmly holds the ignition cable and/or seals it against external influences, is most preferably in the form of a silicone or rubber grommet, on the one hand a good fit is guaranteed and on the other hand the inner life is protected from external influences.

As a further improvement, the structural element includes a fastening and/or supporting means for fastening and/or lateral guidance of the structural member at a point fixed relative to the spark plug, preferably on the engine, more preferably in or at the spark plug shaft, recess and/or the valve cover, wherein the fastening means is preferred a flange. The flange serves simultaneously as a catch—and baffle plate to protect service personnel from injury in the case of engine malfunction when spark plugs fragments are explosively ejected. Alternatively, a rubber grommet or a rubber cap can serve to guide or to attach.

Other possible advantageous embodiments are given if the present inventive subject matter is combined with the inventive subject matter of documents DE 83 196 112 C1 and DE 10 2010 016 881 which were introduced in the discussion of the state of the art.

Exemplary embodiments of the invention will be described in detail with reference to the accompanying drawings.

In the drawings:

FIG. 1 shows a schematic representation of a spark plug connector of the closest state of the art;

Figures 2, 3A, 3B:
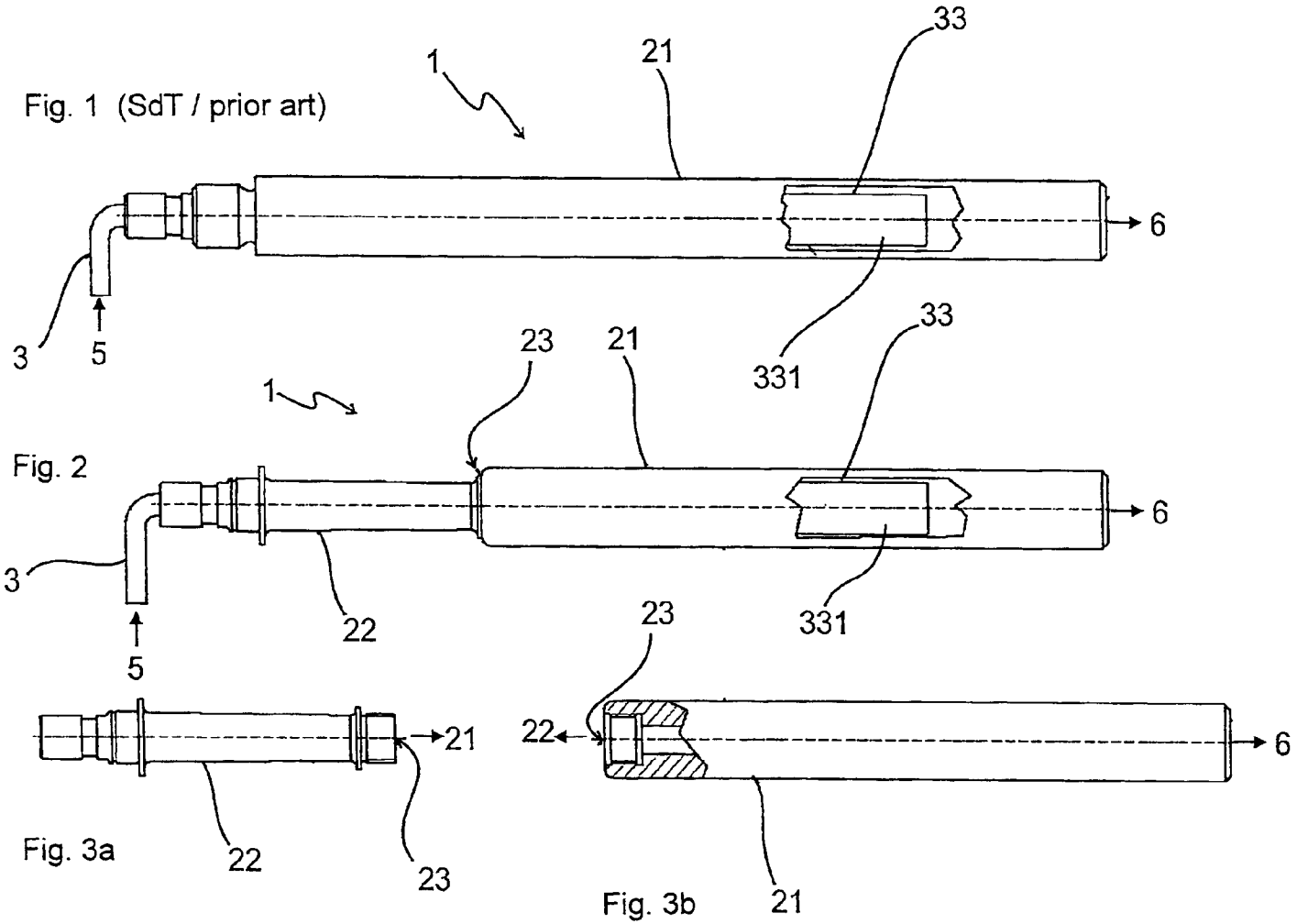
FIG. 2 is a schematic representation of a first embodiment of the spark plug connector according to the invention.
Figure 4:
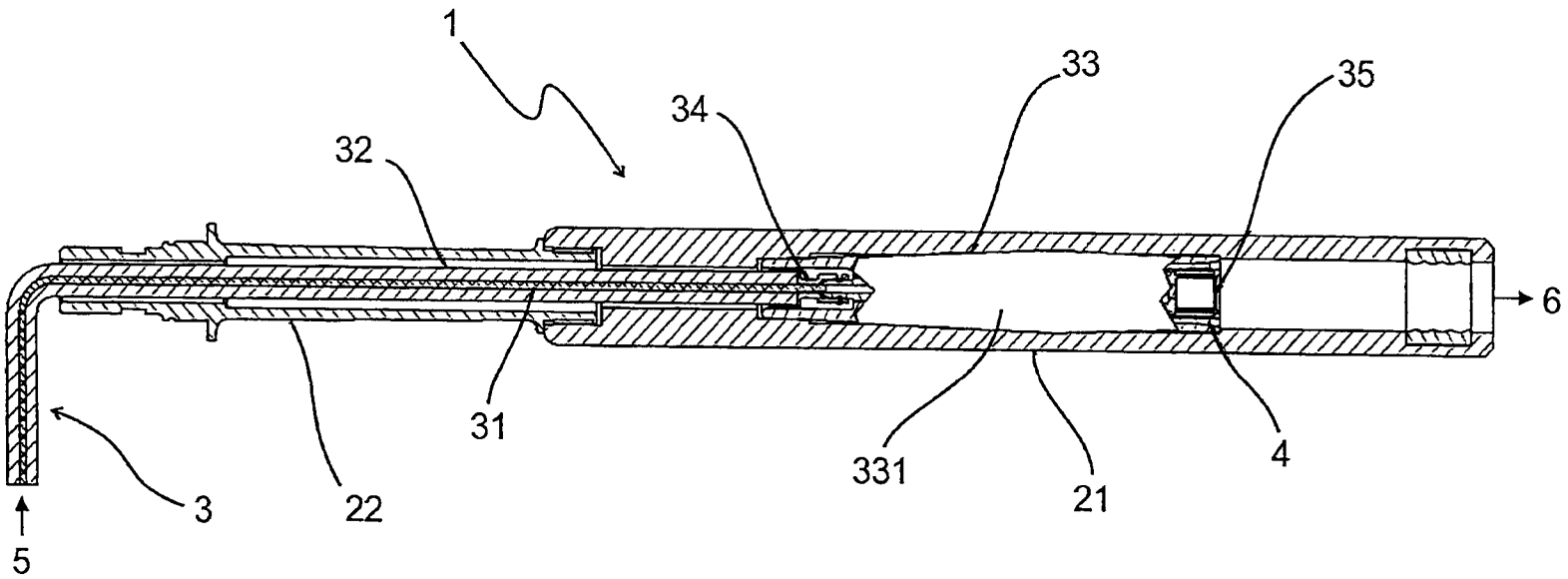
Figure 5:
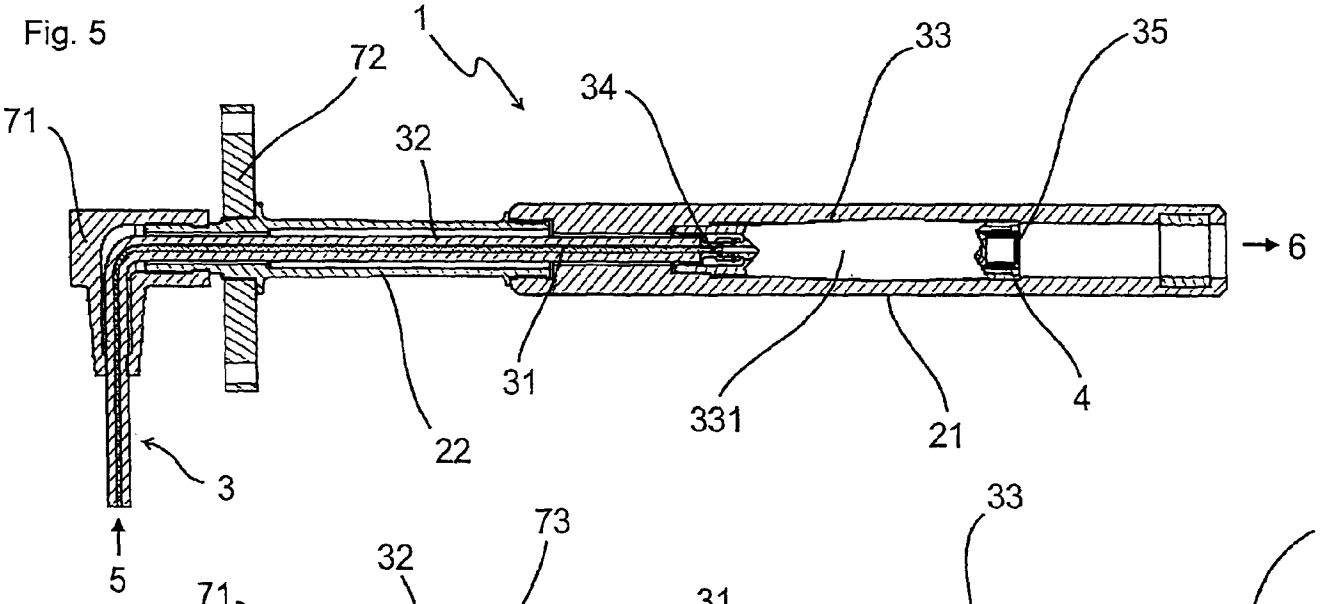
Figure 6:
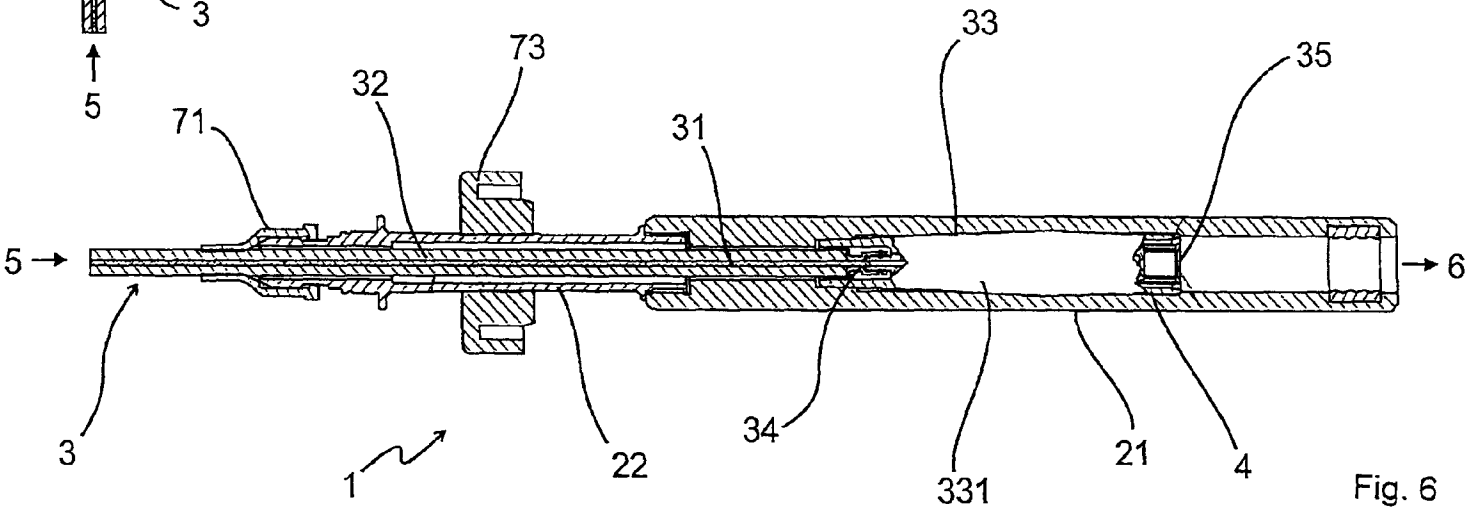

FIG. 3*a* is a schematic representation of the structural element of the invention for a spark plug connector;

FIG. 3*b* is a schematic representation of the inventive connector body (insulator) for a spark plug connector;

FIG. 4 is a schematic illustration of the spark plug connector according to the invention in a sectional representation;

FIG. 5 is a schematic illustration of the spark plug according to the invention in a section view with a flange, as well as a rubber end cap and FIG. 6 is a schematic illustration of the spark plug according to the invention in a sectional illustration showing an end cap and a rubber grommet.

In FIG. 1 a schematic representation of a spark plug of the closest state of the art is illustrated.

The spark plug connector 1 includes a connector body 21 which is formed as an insulator. Inside the connector body 21 an ignition cable 3 is guided, which conducts the ignition voltage from an ignition voltage source 5 to the spark plug 6. Inside is further shown another shield or interference suppressor 33, wherein the shield or interference suppressor 33 comprises an integrated suppression element 331.

The material of the connector body 21 is polytetrafluoroethylene (PTFE). This material extends through the entire length of connector body 21. The length of such a spark plug connector 1 can be up to one meter.

The cost for such a configured connector body 21 is however very high already on the material side, which is why cheaper alternatives were used as an insulator material, which however do not have the same characteristics as the polytetrafluoroethylene (PTFE). In particular, its very good insulation is the main reason for the preferred use as a material for spark plug connector 1. It provides a continuous insulating body.

At the end remote from the high-voltage contact, the spark plug connector 1 has a seal, which at the same time ensures that no contaminants enter the interior of the connector body 21, and further that the ignition cable 3 is held or relieved of strain.

FIG. 2 is a schematic representation of a first embodiment of the spark plug connector 1 of the invention.

This spark plug connector 1 comprises two distinct areas: a first area, the connector body 21, similar to the prior art according to FIG. 1 in the first 10 to 20 cm (the vicinity of the spark plug), and a second region, the structural element 22.

The structural element 22 is connected at a connection point or by a connecting element 23 with the connector body 21. The connector body 21 then takes over the same or similar function of the connector body 21, as formed and shown in FIG. 1.

The connector body 21 in this embodiment is also formed of polytetrafluoroethylene (PTFE) in order to realize sufficient insulation in the vicinity of the spark plug coupling. The structural member 22 in this embodiment is of polyphenylene sulfide (PPS) with a glass fiber content of 40% (GF40) and forms a securing, low-quality insulating structural element 22. The structural member 22 is a mechanically wearing part, and serves to guide and position of the ignition cable 3, with less of a function of providing insulation for the spark plug connector 1.

Experiments, simulations and calculations have shown in this connection that only the vicinity of the connector body 21 in the region of the spark plug 6, a length of about 10 to 20 cm, must be insulated so that the necessary insulation would be ensured. However, at the same time it is necessary to design the spark plug connector over the remaining length, which is ensured by the structural element 22.

In FIG. 3*a* is a schematic representation of the structural element 22 of the invention is shown for a spark plug connector 1.

The structural element 22 has substantially the components which were already explained in FIG. 1. In particular, the transition region to the connector body, namely, the junction 23 is shown. The connection of the structural member 22 with the connector body 21, can be provided by, for example, a catch, a screw, a bayonet lock, a clamping or gluing. Alternatively, the materials can also be connected to each other via a welding method, preferably an ultrasonic welding process, in certain cases via an inserted contact element.

The structural element 22 is in particular, in a preferred embodiment, dimensionally stable, has a material melting point of about 280° C. and is resistant to chemicals.

The structural member 22 can be manufactured at low cost especially in an injection molding process and can be stored in different length increments.

In FIG. 3*b* is a schematic representation of the connector body (insulator) 21 of the present invention is shown for a spark plug connector 1.

The connector body 21 has substantially the elements, which are known from FIG. 0, to which are added the junction and the connecting element 23. The sleeve is comprised in particular of polytetrafluoroethylene (PTFE).

FIG. 4 shows a schematic illustration of the spark plug connector 1 of the invention in a sectional representation.

As a further essential elements of the spark plug connector 1, there are the spark plug high voltage contact 35 for the spark plug 6 and the high-voltage contact 34. The ignition cable 3 consists essentially of a high-voltage conductor 31 and a high-voltage insulation 32.

Further yet, the molding material 4 that is preferably used herein is to be mentioned. By means of the sealing or grouting compound, the electrical function element (interference suppressor) is embedded in a separate insulation. All other elements essential to the invention are explained in the preceding figure descriptions. Reference is made to these figures.

In FIG. 5, the spark plug connector 1 of the invention is shown in a section view with a flange 72 and a rubber end cap 71.

In particular, the flange 72 is provided in metal composition on the structural member 22. The metal flange 72 is used for the screw fastening of the spark plug connector 1, for example on or against the valve cover and/or plug shaft.

Further, the spark plug connector 1 has an end rubber cap 71, which is formed in this embodiment angled at 90° and so guides the ignition cable 3 on the upper end of the spark plug connector 1 at an angle of 90° from the spark plug connector 1.

FIG. 6 shows a schematic illustration of the spark plug connector 1 of the invention in a sectional illustration showing an end-cap 71 and a rubber grommet 73.

The seal at the end of the spark plug connector 1 is performed with an end-rubber cap 71, which protects the inside of the spark plug connector 1 from contamination and the like.

Further, a rubber grommet 73 is provided and slid to the structural element 22. The grommet 73 may be configured differently. Both length and girth as well as material of the rubber grommet 73 may be adapted to the circumstances (plug shaft, etc.). The grommet 73 is used to fix and guide the spark plug connector 1 in the plug shaft of the motor.

LIST OF REFERENCE NUMERALS

1 spark plug connector
21 connector body (insulator)
22 structural element
23 connecting element/connecting point
3 ignition wire
31 high-voltage conductor
32 high-voltage insulation
33 shield or interference suppressor
331 integrated interference suppression element
34 high-voltage contact
35 spark plug high voltage contact
4 grout
5 ignition voltage source
6 spark plug
71 end rubber cap
72 flange
73 rubber grommet

The invention claimed is:

1. A spark plug connector (1) comprising a connector body (21) formed as an insulator having a spark plug high voltage contact (35) for producing a connection to and with a spark plug (6), an ignition cable (3) entering the connector body (21) on the side remote from the spark plug high voltage contact for transmission of an ignition voltage from an ignition voltage source (5) to the spark plug (6), a spark plug connector (1) extending structural element (22) received, mounted and/or connected on the connector body (21) at a connection point (23) on the side of the connector body (21) remote from the spark plug high voltage contact, wherein the structural element (22) is arranged at the connection point (23) in such a manner such that the structural element (22) lengthens the connector body (21) on the side remote from the spark plug high voltage contact, wherein the ignition cable (3) is held or guided along the length of the structural element (22) and wherein the material of the structural element has a higher rigidity and strength and/or a lower density with at the same time less material than the material of the connector body (21).

2. The spark plug connector (1) according to claim 1, wherein the material of the connector body (21) is ceramic or plastic.

3. The spark plug connector (1) according to claim 1, wherein the material of the structural element (22) is a plastic, provided with reinforcing fibers.

4. The spark plug connector (1) according to claim 1, wherein the ignition cable (3) from the junction (23), exiting the connector body (21), is guided within the structural element (22), wherein the passage within the structural element (22) for the ignition cable is configured as a channel with a larger diameter than the outer diameter of the ignition cable (3).

5. The spark plug connector (1) according to claim 1, wherein the connection point or the connection element (23) forms a permanent connection between the connector body (21) and the structural element (22), wherein the connection of the connector body (21) and the structural element (22) is produced by gluing, screwing, a bayonet fitting, a compression and/or welding.

6. The spark plug connector (1) according to claim 1, wherein the structural element (22) is made of polyphenylene sulfide with a glass fiber content of 30 to 40%.

7. The spark plug connector (1) according to claim 1, wherein the structural element (22) has a cable outlet on the side remote from the spark plug high voltage contact, wherein the cable exit firmly locks the spark plug wire (3) and/or seals it against external influences.

8. The spark plug connector (1) according to claim 1, wherein the structural element (22) includes a fastening and/or supporting means for fastening the structural element (22) at a point on the engine fixed relative to the spark plug (6).

9. The spark plug connector (1) according to claim 1, wherein the material of the connector body (21) is polytetrafluoroethylene (PTFE).

10. The spark plug connector (1) according to claim 1, wherein the material of the structural element (22) is a high-performance plastic with an impact strength of 9-12 kJ/m$^2$, a heat deformation resistance of up to 260° C. and/or a high melting temperature of 280° C., mixed with a glass fiber content of 20 to 50%.

11. The spark plug connector (1) according to claim 1, wherein the material of the structural element (22) is a high-performance plastic with an impact strength of 9-12 kJ/m$^2$, a heat deformation resistance of up to 260° C. and/or a high melting temperature of 280° C., mixed with a glass fiber content of 30 to 40%.

12. The spark plug connector (1) according to claim 1, wherein the ignition cable (3) from the junction (23), exiting the connector body (21), is guided within the structural element (22), wherein the passage within the structural element (22) for the ignition cable is configured as a closed channel, and with a larger diameter than the outer diameter of the ignition cable (3).

13. The spark plug connector (1) according to claim 1, wherein the structural element (22) is made of polyphenylene sulfide with a glass fiber content of 40%.

14. The spark plug connector (1) according to claim 1, wherein the structural element (22) has a cable outlet on the side remote from the spark plug high voltage contact, wherein the cable exit firmly locks the spark plug wire (3) and/or seals it against external influences, and is in the form of a rubber bushing (73).

15. The spark plug connector (1) according to claim 1, wherein the structural element (22) includes a fastening and/or supporting means for fastening the structural element (22) in or at the spark plug shaft and/or core.

16. The spark plug connector (1) according to claim 1, wherein the structural element (22) includes a fastening and/or supporting means for fastening the structural element (22), wherein the fastening means is a flange (72), a rubber stopper and/or a plastic or rubber cap (71) or rubber grommet (73).

* * * * *